US005749412A

United States Patent [19]

Balthazard

[11] Patent Number: 5,749,412

[45] Date of Patent: May 12, 1998

[54] HEAT EXCHANGER HAVING A TUBULAR HEADER WITH A FASTENING LUG

[75] Inventor: Patrick Balthazard, Guignicourt, France

[73] Assignee: Valeo Thermique Moteur, Le Mesnil-Saint Denis, France

[21] Appl. No.: 850,521

[22] Filed: May 2, 1997

[30] Foreign Application Priority Data

May 3, 1996 [FR] France ..... 96 05578

[51] Int. Cl.[6] ..... F28F 9/02

[52] U.S. Cl. ..... 165/67; 165/153; 165/175; 165/173

[58] Field of Search ..... 165/67, 151, 153, 165/173–176

[56] References Cited

U.S. PATENT DOCUMENTS

| | | | |
|---|---|---|---|
| 5,183,107 | 2/1993 | Le Gauyer | 165/176 |
| 5,341,872 | 8/1994 | Mercurio | 165/173 |
| 5,596,877 | 1/1997 | Morrison | 165/176 X |

FOREIGN PATENT DOCUMENTS

| | | | |
|---|---|---|---|
| 512903 | 11/1992 | European Pat. Off. . | |
| 295 09 565 | 8/1995 | Germany . | |
| 3192 | 1/1988 | Japan | 165/176 |
| 73599 | 3/1992 | Japan | 165/174 |
| 363591 | 12/1992 | Japan | 165/175 |
| 759832 | 10/1956 | United Kingdom | 165/173 |
| 904498 | 8/1962 | United Kingdom . | |

*Primary Examiner*—Leonard R. Leo
*Attorney, Agent, or Firm*—Morgan & Finnegan, L.L.P.

[57] ABSTRACT

A heat exchanger, especially a condenser for an air conditioning system in a motor vehicle, includes a tubular header which comprises a tubular wall formed with aligned holes in which the ends of tubes of the heat exchanger are fixed. The header has a fastening lug. The tubular header has a longitudinal slot, and the fastening lug is part of a component which also includes a spine portion from which the fastening lug projects. This component is inserted into the slot and is then brazed to the tubular wall of the header.

11 Claims, 2 Drawing Sheets

HEAT EXCHANGER HAVING A TUBULAR HEADER WITH A FASTENING LUG

FIELD OF THE INVENTION

This invention relates to heat exchangers, in particular for use in motor vehicles. More particularly, the invention relates to a heat exchanger of the type having at least one header which comprises a tubular wall formed with a set of aligned holes, in which the ends of heat exchange tubes of the heat exchanger are received, the header also including a fastening lug which is fixed to the tubular wall.

BACKGROUND OF THE INVENTION

A heat exchanger of this kind can be made, in particular, in the form of a condenser which then forms part of an air conditioning installation for a motor vehicle, with a refrigerant fluid being passed through the condenser. In such a heat exchanger, the fastening lug can be used for securing the heat exchanger, e.g. a condenser, either to the bodywork of the vehicle or to some other item of equipment on the vehicle. In this connection, it is typical current practice to secure the condenser of an air conditioning installation on another heat exchanger, such as the engine cooling radiator of the vehicle, in such a way that the same stream of air is passed first through the engine cooling radiator and then through the condenser, which is accordingly aligned with the engine cooling radiator.

Known types of fastening lugs used in this connection typically consist of two parts, which are adapted to embrace the header of the heat exchanger, being secured together by means of a rivet or a screw as disclosed in French patent specification FR 2 690 234A. This known arrangement makes it necessary to perform an additional operation, and also necessitates particular arrangements on the heat exchanger for fitting the fastening lug itself. All this increases the manufacturing costs and fitting costs of the heat exchanger.

It is also known to secure the fastening lug to the heat exchanger header by means of a brazing operation. However, this makes it necessary to hold the fastening lug in position both before and during the brazing operation, which tends to result in a complicated geometry in the design of the fastening lugs.

DISCUSSION OF THE INVENTION

A main object of the invention is to overcome the various drawbacks discussed above.

According to the invention, a heat exchanger of the type comprising: a header having a tubular wall which is formed with aligned holes; tubes, the ends of which are received in the holes of the header; and at least one fastening lug fixed to the header, is characterised in that the header is formed with a longitudinal slot having a given length and a given width, and in that the fastening lug projects from a metallic spine portion having a length and a thickness which are matched to the length and width of the said slot respectively, so that the fastening lug and spine portion can be introduced into the slot and then brazed to the tubular wall, the spine portion having an inner longitudinal edge which lies spaced away from the tubular wall on the side of the latter having the holes.

Thus, the fastening lug forms part of a metallic component which is secured by brazing to the header, the header having for this purpose a particular configuration in which it is formed with a slot. Consequently, the spine portion from which the fastening lug projects is simply slid into the longitudinal slot in the tubular header before being brazed to the latter.

Preferably, the slot extends over substantially the whole length of the tubular wall.

According to a preferred feature of the invention, the header is formed by rolling and stamping of a strip of metal plate, so that the header has two parallel longitudinal edges extending along the generatrices of the tubular wall and defining the slot between them. The rolling operation is accordingly carried out in such a way that the longitudinal slot thereby obtained has a width which is slightly greater than the thickness of the metal spine portion from which the fastening lug projects.

According to another preferred feature of the invention, the inner longitudinal edge of the spine portion is parallel to the generatrices of the tubular wall, and lies at a given distance from the tubular wall so as to serve as an abutment for the ends of the tubes.

According to a further preferred feature of the invention, the spine portion has at least one slot formed in the inner longitudinal edge of the spine portion, the or each said slot being situated in a selected position along the length of the spine portion, for receiving a partition located within the tubular wall of the header. It is thus possible to provide a number of slots which are adapted to receive a plurality of partitions. Thus the partitions, and the fastening member which comprises the spine portion, can be introduced into the interior of the header by insertion in a single pass, instead of their being introduced one at a time as in the method of assembly currently used.

In addition, this feature avoids the need for upsetting or seaming operations on the partitions. Up to the present time, these operations have been necessary, but are avoided in the assembly of a heat exchanger according to the present invention, due to the fact that the partitions are held in position by the slots formed in the spine portion.

The spine portion is preferably in the form of a generally rectangular metallic strip which is further delimited by an outer longitudinal edge parallel to the inner longitudinal edge, the outer longitudinal edge being arranged to lie outside the tubular wall of the header. This outer longitudinal edge preferably overlaps, or extends outwardly from, the tubular wall of the header.

According to yet another preferred feature of the invention, the tubular wall has an aperture, and the spine portion has a notch which is located in facing relationship with the aperture in the tubular wall, for location of a connecting piece, such as a tubular connecting element, in position in the said aperture and notch. This aperture, and the notch in register with it, accordingly cooperate with each other so as to enable the connecting piece to be located in position during the brazing operations.

According to a still further preferred feature of the invention, the spine portion has a minimum width which is greater than the thickness of the tubular wall. This feature enables good sealing to be guaranteed during the brazing operation.

According to another preferred feature of the invention, the fastening lug is disposed in a selected position and a selected orientation with respect to the spine portion. Thus, one or more fastening lugs can be arranged in selected locations, for example at the end of the spine portion or anywhere else along the length of the latter.

It will of course be understood that the fastening lug itself has a configuration which is adapted for the particular fastening purpose for which it is intended.

According to a further preferred feature of the invention, the fastening lug and the spine portion are integral with each other and together constitute a fastening member, formed by stamping from a metallic workpiece, or formed by casting or extrusion. The said fastening member is preferably coated with a braze alloy.

Further features and advantages of the invention will appear more clearly on a reading of the following detailed description of a heat exchanger in some preferred embodiments of the invention, which is given by way of non-limiting example only and with reference to the accompanying drawings.

DESCRIPTION OF PREFERRED EMBODIMENTS OF THE INVENTION

Figure 1:
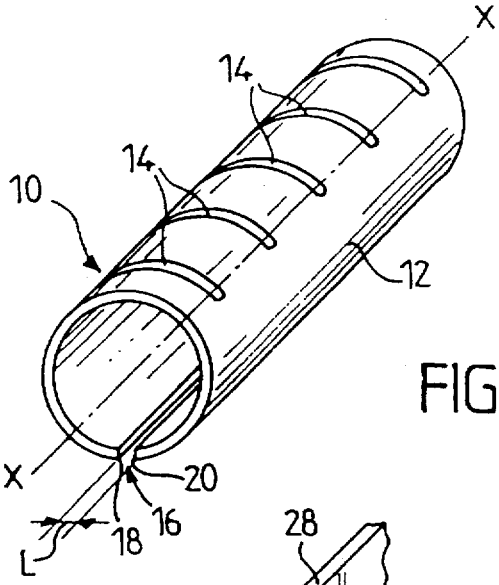
FIG. 1 is a perspective view of part of a header of a heat exchanger in a first embodiment of the invention.

Reference is first made to FIG. 1, which shows a tubular header 10 of circular cross section defining an axis XX. The header 10 comprises a tubular wall 12 which is formed with aligned holes 14, each of which is in the form of an oblong passage through the wall 12. The header 10 is also provided with a longitudinal slot 16 which extends parallel to the axis XX, and which is bounded by two longitudinal edges 18 and 20, parallel to each other and parallel to the generatrices of the tubular wall 12. The two longitudinal edges 18 and 20 together define the width L of the slot 16. In this example, the slot 16 extends over the whole length of the header 10, only part of which is shown in FIG. 1. The tubular wall 12 of the header is preferably formed to shape by rolling and punching of a strip of metal plate, for example of aluminium or of aluminium alloy.

Figure 2:
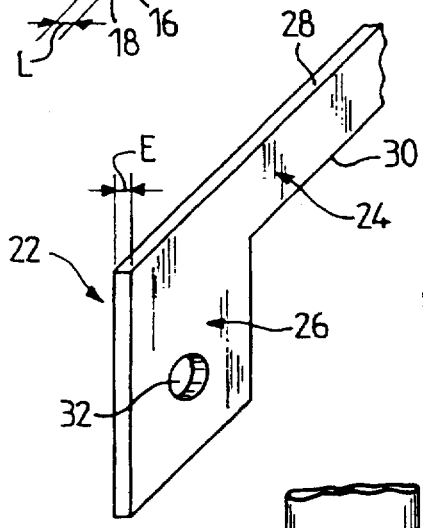
FIG. 2 is a perspective view showing a fastening member which is adapted to be brazed to the header shown in FIG. 1.

Reference is now made to FIG. 2, which shows a fastening member 22 comprising a rectangular spine portion 24, one end of which is extended by a laterally projecting fastening lug 26. The spine portion 24 includes, in particular, an inner longitudinal edge 28 and an outer longitudinal edge 30, which are parallel to each other. The fastening lug 26 projects in a general direction at right angles to the longitudinal direction of the spine portion 24. The lug 26 has a through hole 32, through which a suitable fastener (not shown), such as a screw, is passed. The fastening member 22 constitutes a monobloc component which can be made either by stamping a workpiece of metal plate or strip material in the press, or by casting or extrusion in a suitable metallic material. The fastening member 22 is preferably made in the same metallic material as the header 10, that is to say preferably aluminium or an aluminium alloy.

The thickness E of the spine portion 24 is slightly smaller than the width L of the slot 16. It also extends over a length which corresponds to that of the slot 16, that is to say over the whole length of the headers 10 in this example.

Figure 3:
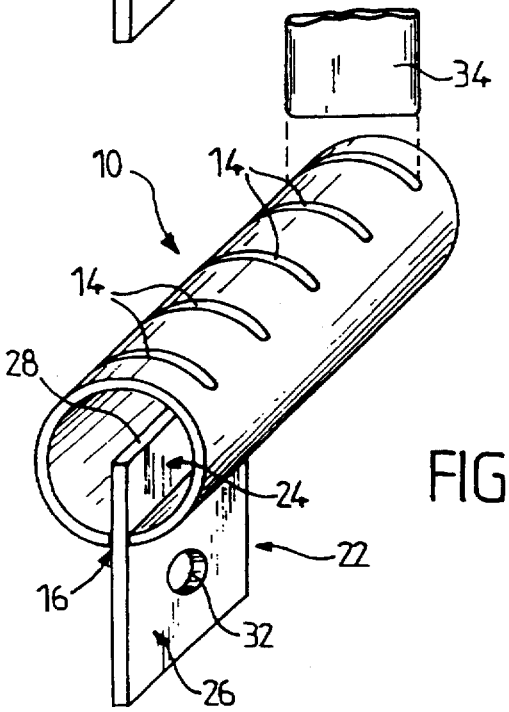
FIG. 3 is a perspective view showing the header of FIG. 1 and the fastening member of FIG. 2, after they have been assembled and brazed together.

The spine portion 24 is adapted to be introduced into the interior of the header 10 by inserting it through the slot 16 as shown in FIG. 3. The fastening member 24 is then secured in a position in which the inner longitudinal edge 28 is parallel to the generatrices of the tubular wall 12. In this example, the edge 28 lies substantially in alignment with the axis XX. In the position thus obtained, the inner longitudinal edge 28 serves as an abutment during the introduction of heat exchanger tubes 34 through the holes 14 and into the header 10, as indicated in FIG. 3. The heat exchanger tubes 34 have an oblong cross section which is matched to that of the holes 14 in the header. Thus, when the tubes 34 are inserted through the holes 14, they come into abutment against the inner longitudinal edge 28 of the fastening member 22, which then maintains the tubes in the required position before they are secured to the header by brazing.

To facilitate the brazing operation, the fastening member 22 is preferably coated over both its faces with a coating of an appropriate braze metal. Similarly, it is preferable that the tubes 34 are also coated externally with a layer of braze metal. A further layer of braze metal is also, if necessary, applied by coating on the outside of the wall 12 of the header.

It should be noted that in the arrangement seen in FIG. 3, the outer longitudinal edge 30 of the spine portion 24 of the fastening member 22 must at least project outside the tubular wall 12, so as to give good mechanical connection between the fastening member 22 and the header 10. In this example, the fastening lug 26 is a generally rectangular flat lug, which lies in the same plane as the spine portion 24 and which is, as mentioned above, situated at one end of the latter. However, this fastening lug could of course be situated in any other position along the length of the spine portion, and it may take a different form, being for example curved or bowed. It is equally possible to provide several fastening lugs projecting from the spine portion 24.

Figure 4:
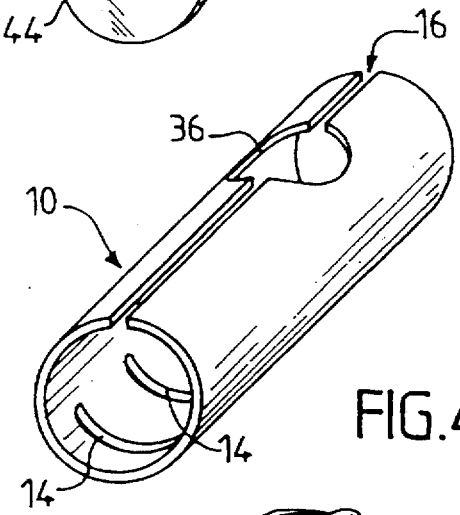
FIG. 4 is a perspective view of a heat exchanger in a second embodiment of the invention.
Figure 6:
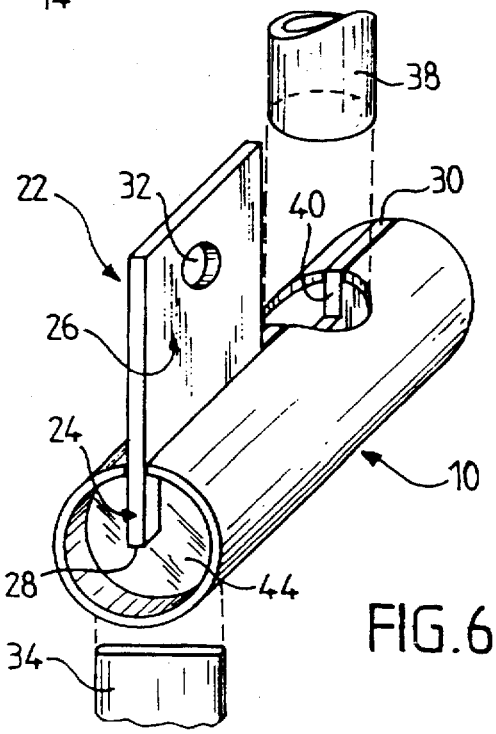
FIG. 6 is a perspective view showing part of the header of FIG. 4, together with the fastening member of FIG. 5, after they have been assembled and brazed together.

Reference is now made to FIG. 4, which shows a header 10 similar to that in FIG. 1, and again having holes 14 and a slot 16. However, in this example the tubular wall 12 includes an aperture 36 which intersects the slot 16. A connecting piece 38, which may for example be a tubular connector for a fluid inlet or outlet, is introduced into the header 10 through the aperture 36, as indicated in FIG. 6. The fluid which enters or leaves the header via the connecting piece 38 is a heat transfer fluid, that is to say, in this example, a refrigerant fluid.

Figure 5:
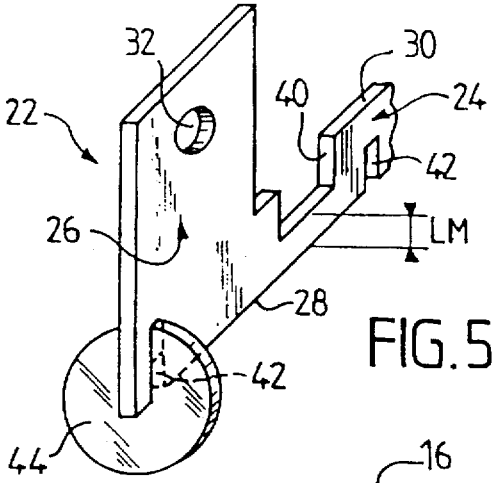
FIG. 5 is a perspective view showing part of another fastening member, designed to be fixed to the header of FIG. 4.

As is shown in FIG. 5, the spine portion 24 of the fastening member 22 in this embodiment has a rectangular notch 40 which is formed in the outer longitudinal edge 30 of the spine portion 24. The form of the notch 40 is matched to that of the aperture 36 in the header 10. In addition, the spine portion 24 is formed with rectangular slots 42 in the inner longitudinal edge 28 of the spine portion. A partition 44 is received in each of the slots 42. These partitions are arranged to be located inside the tubular wall 12 of the header. FIG. 5 shows one of these partitions 44, at one end of the fastening member 22.

The fastening member 22 is first fitted with its partitions 44, and it is then inserted longitudinally into the header 10 in the direction of the axis XX, until the aperture 36 in the header and the notch 40 in the fastening member 22 are in register with each other, as can be seen in FIG. 6. All that then needs to be done is to fit the connecting piece 38 and then to fit the heat exchanger tubes 34, followed by brazing of the whole of the resulting assembly. It will be clear from the above description and the drawings that the partitions 44 are firmly retained in the required positions, which avoids the need for any upsetting or seaming operations of the kind that have been necessary up to the present time.

With reference to FIG. 5, the notch 40 and slots 42 in the spine portion 24 represent local reductions in the width of the spine portion as defined between its longitudinal edges 28 and 30. It is however necessary to retain a minimum width LM, in particular in the region of the notch 40, so as to ensure good connection between the fastening member 22 and the header 10. This minimum width LM must be greater than the thickness of the tubular wall 12.

The heat exchanger tubes 34, the ends of which are introduced through the holes 14 of the header 10, may be either straight tubes or U-tubes. In the former case, a further header, identical or similar to the header 10, must be provided at the other ends of the tubes. This other header may be slotted and have at least one fastening lug, secured to it by brazing as already described. In the case where the heat exchanger tubes are U-shaped, the heat exchanger has only one header.

Figure 7:
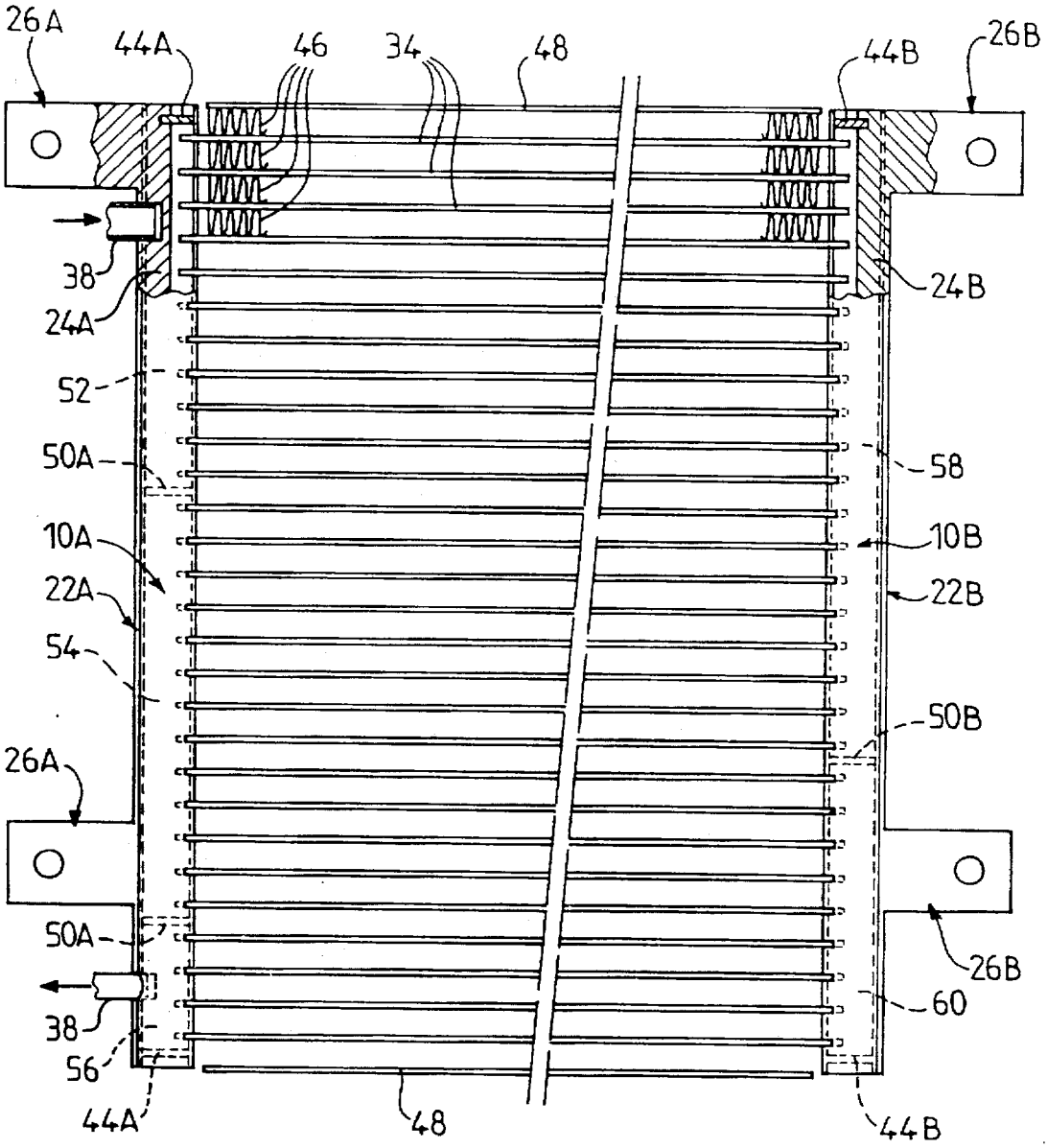
FIG. 7 is a front view, shown partly cut away, of a heat exchanger having two headers in accordance with the invention.
Figure 8:
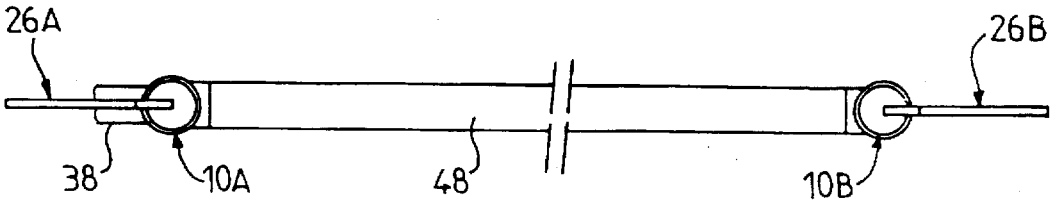
FIG. 8 is a top plan view of the heat exchanger shown in FIG. 7.

Reference is now made to FIGS. 7 and 8, which show a heat exchanger having two headers 10A and 10B constructed in accordance with the invention. The headers 10A and 10B are mounted at the respective ends of the heat exchanger tubes 34, which constitute a tube bundle. Corrugated inserts 46, constituting heat transfer fins, are disposed between the tubes 34. In addition, the bundle of tubes 34 is flanked by two end pieces 48.

The header 10A has two fastening members 22A, each having a spine portion 24A from which a fastening lug 26A projects. The header 10B has two fastening members 22B, each having a spine portion 24B from which a fastening lug 26B projects.

The header 10A has two end partitions 44A and two intermediate partitions 50A. In addition, the header 10B has two end partitions 44B and one intermediate partition 50B. The header 50A defines an internal inlet chamber 52, an intermediate chamber 54, and an outlet chamber 56. The header 10B has only two internal chambers, 58 and 60. In addition, the header 10A has two connecting pieces 38 as described above, which provide an inlet and an outlet respectively for the heat transfer fluid which is to flow through the tube bundle.

In this example, the heat exchanger is a condenser, the heat transfer fluid being a refrigerant fluid which enters the condenser in the vapour phase and leaves it in the liquid phase, after having been condensed in the heat exchanger by a stream of air which is passed over the tube bundle. The refrigerant fluid enters the condenser via the inlet chamber 52, and passes from there, through some of the tubes 34, to the chamber 58, whence it passes back to the intermediate chamber 54 via a middle group of the tubes 34, passing thence via more of the tubes 34, the chamber 60, and the remaining tubes 34, to the outlet chamber 56.

Heat exchangers according to the invention are suitable most particularly to be used as condensers in air conditioning installations for motor vehicles. However, the invention is of course not limited to the embodiments described above by way of example, and it does extend to other versions, especially as regards the configuration and position of the fastening lug with respect to the header.

What is claimed is:

1. A heat exchanger comprising: a header in the form of a tubular wall having aligned through holes; heat exchanger tubes having end portions received in the aligned holes in the header; and a fastening member comprising at least one fastening lug projecting outwardly from the said tubular wall, wherein the tubular wall defines a longitudinal slot of given length and width, the header including a member comprising a spine portion, and the fastening lug, the fastening lug being fixed with respect to, and projecting from, the spine portion, the spine portion having a length and a width which are matched to the length and width, respectively, of the slot in the tubular wall, so that the spine portion can be assembled with the tubular wall by being introduced into the slot and then brazed to the tubular wall, the spine portion defining an inner longitudinal edge disposed within the tubular wall of the header and spaced away therefrom, on a side of the header defining the holes.

2. A heat exchanger according to claim 1, wherein the slot in the tubular wall extends over substantially an entire length of the tubular wall.

3. A heat exchanger according to claim 2, wherein the tubular wall is formed by rolling and punching a strip of metal plate so as to define two parallel longitudinal edges extending along generatrices of the tubular wall and defining the slot therebetween.

4. A heat exchanger according to claim 1, wherein the inner longitudinal edge of the spine portion is parallel to generatrices of the tubular wall, and is located at a given distance away from the tubular wall, the ends of the tubes being abutted on the inner longitudinal edge.

5. A heat exchanger according to claim 1, wherein the spine portion defines at least one slot in its inner longitudinal edge, the or each said slot being located in a selected position along the length of the spine portion, the header further including at least one partition fitted within the tubular wall, the or each said partition being received in a respective said slot of the spine portion.

6. A heat exchanger according to claim 1, wherein the spine portion is in the form of a generally rectangular metallic strip, further having an outer longitudinal edge parallel to the inner longitudinal edge and located outside the tubular wall.

7. A heat exchanger according to claim 1, wherein the tubular wall has a through aperture, and the spine portion has a notch located in register with the aperture in the tubular wall, the header further including a hollow connecting piece for passage of a fluid, the connecting piece being fitted through the aperture and in the notch.

8. A heat exchanger according to claim 1, wherein the spine portion has a minimum thickness greater than the thickness of the tubular wall.

9. A heat exchanger according to claim 1, wherein the fastening lug is located in a selected position and a selected orientation with respect to the spine portion.

10. A heat exchanger according to claim 1, wherein the fastening member comprises the fastening lug and the spine portion as a single metallic component.

11. A heat exchanger according to claim 10, wherein the metallic component has a coating of braze alloy.

* * * * *